United States Patent [19]

Gasparini et al.

[11] 4,393,629

[45] Jul. 19, 1983

[54] EXTRUDED SNAP-FASTENING FOR SLATS AND METAL AWNING MADE THEREWITH

[75] Inventors: Aldo Gasparini, Kungsportsavenyn 34; Nils E. Wimnell, Karl Gustavsgatan 59, both of 411 36 Goeteborg, Sweden

[73] Assignees: Aldo Gasparini; Nils Erik Wimnell

[21] Appl. No.: 260,685

[22] Filed: May 5, 1981

[51] Int. Cl.[3] ..... E04B 1/34

[52] U.S. Cl. ..... 52/74; 52/473

[58] Field of Search ..... 52/74, 75, 76, 77, 78, 52/473, 732

[56] References Cited

U.S. PATENT DOCUMENTS

| | | | |
|---|---|---|---|
| 2,747,242 | 5/1956 | Ellman | 52/78 X |
| 2,881,485 | 4/1959 | Hallock | 52/473 |
| 3,234,697 | 2/1966 | Toti et al. | 52/75 |
| 3,803,790 | 4/1974 | Buck et al. | 52/78 X |
| 3,991,533 | 11/1976 | Nagase | 52/473 |

FOREIGN PATENT DOCUMENTS

| | | | |
|---|---|---|---|
| 2532153 | 2/1976 | Fed. Rep. of Germany | 52/74 |
| 1348741 | 3/1974 | United Kingdom | 52/74 |

*Primary Examiner*—Philip C. Kannan

*Attorney, Agent, or Firm*—Frishauf, Holtz, Goodman & Woodward

[57] ABSTRACT

The upper edge of an awning slat that is suspended obliquely in position is bifurcated into a channel-like structure running along the edge, having inwardly projecting beads on the free edges of the channel. For suspension of the slat, at various places along its length, the beaded channel is forced to spread and snap into notches behind twin barbs of a bracket. Each bracket has parallel ridges bending out from a base to meet the bifurcated grasping webs of the awning slat, the ridges of the bracket being barbed, so as to provide an oblique surface to spread the connecting webs of the awning edge apart until their beads snap into grooves between the barbs and the bracket base. The awning slat with its bifurcated edge is integrally made by extrusion of aluminum alloy and the brackets are relatively short pieces of aluminum alloy extrusions.

11 Claims, 6 Drawing Figures

EXTRUDED SNAP-FASTENING FOR SLATS AND METAL AWNING MADE THEREWITH

This invention concerns snap fastenings from which slats of metal awnings may be supported for shading the walls of buildings and the like from sunlight while permitting air circulation for cooling and for reduction of windage.

U.S. Pat. No. 2,881,484 shows louver blades held by brace brackets engaging a rib near the bottom of the blade and also engaging a lip at the top edge of a blade. Optionally, a channel clip can be used to reinforce the top edge catches by clipping blade and bracket together. The brackets shown are suitable only for a slat or blade adjacent to a vertical surface.

U.S. Pat. No. 3,234,697 shows slats that are snapped into place utilizing various kinds of bent-over edges or bent-in ridges to interfit, for awnings made of slats running out from a building rather than along it. The slats fit into each other, edge to edge.

THE INVENTION

It is an object of the present invention to provide fastenings by which extensive awnings economically made of aluminum extrusions, mounted horizontally in a spaced array that may may extend at some distance from a building wall while allowing air movement between the slats, can be assembled on simple supports provided on the wall of the building.

It is a further object that the snap fastenings should directly join an awning slat edge to a bracket member without requiring any additional separate member to hold a slat to a support bracket.

It has been discovered that extruded aluminum made in suitable shapes can furnish snap fastenings of a channel type that have the necessary resilience and the necessary permanence in holding strength to withstand the torque produced by suspending a slat obliquely from one edge, thus assuring easy assembly and even replacement, free of the risk that the fastening will weaken with time and drop slats on people below, or allow the slats to be blown off by the wind to break windows or cause other damage.

Briefly, a bracket is provided having a barbed channel portion, for suspending a slat by a beaded channel portion thereof running along one edge of the slat, this slat portion having edge beads fitting into rectangular slots behind the channel barb. The bracket is made of extruded aluminum with a base that either is flat or has a suspension flange for holding the bottom of the barbed channel vertically disposed while suspending it from a cross-beam. The bracket's channel portion has parallel ridges extruded integrally with the base with a barb profile preferably directed externally of the channel along the top of each ridge. The slats, for support upon the channel members, then have an enveloping channel along the mounting edge. This can be of thinner profile, comparable with the thickness of the slat itself. Inward beads along the terminal edges of the enveloping channel are provided so that the slat can be snapped onto the fixed channel member quite easily. The supporting channel member does not need to be provided along the entire length of the slat and it is sufficient to provide small supporting channel lengths at intervals. It is important that the barbed ridges be spaced apart to provide an adequate fastening base spread for holding the slat at a defined angle by one edge without the necessity of a brace to its far edge or to somewhere in the slat middle.

DRAWINGS

The invention is further described by way of illustrative example with reference to the annexed drawings, in which.

Figure 1:
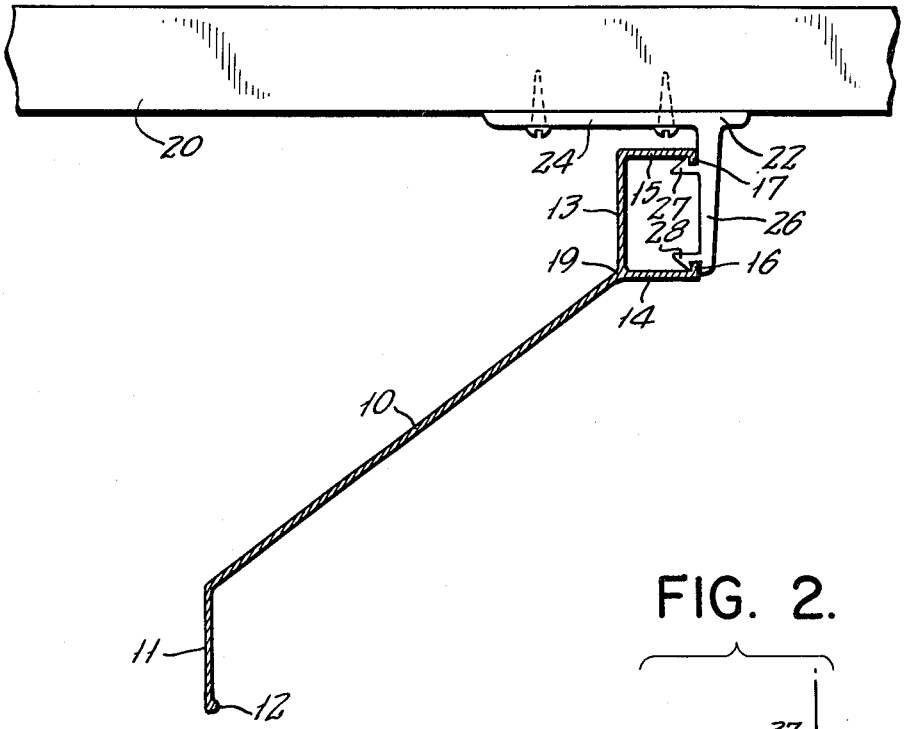
FIG. 1 is a cross-section of an awning slat supported by snap fastening where it engages a barbed channel portion of a bracket fastened on the bottom of a cross-beam.

As shown in FIG. 1, the awning slat 10, as supported, has a main part of its width disposed obliquely for intercepting sunlight coming obliquely downwards from the left. The slat has a vertical lip 11 at its lower edge terminating in a bead 12. Its upper, or rear edge, is formed, in the extrusion process by which the slat 10 is made, into a channel of which the vertical portion 13 forms the bottom of the U and the two parallel horizontal webs 14 and 15 form the legs of the U-profile, completing the channel. The webs 14 and 15 each have an inward bead, or lip, respectively shown at 16 and 17, of approximately square cross-section.

Suspended on the cross-beam 20, extending outward from the wall of a building (not shown), is a support bracket 22, which is seen in end view rather than cross-section because it does not extend from cross-beam to cross-beam, but rather only a small length of bracket profile is provided at each cross-beam for suspending the awning slat 10.

The barbed ridges of the bracket are typically spaced from 1 to 3 cm apart. The wider and heavier the slat, and the more exposed to strong wind, the greater this spacing should be. The spacing provides a sufficient spread between the upper notch 37 (FIG. 2) where the bead 17 pulls against the adjacent channel barb and the lower notch 36 where the bead 16 pushes against the far edge of the notch (the base 32 in FIG. 2, or 26 in FIG. 1) to enable the torque of the obliquely hanging slat to be taken up without stress that would cause the joint to fail. For a slat some 10 or 12 cm wide, a distance of 2 cm from the bottom of notch 36 to the bottom of inverted notch 37 (FIG. 2) is about right.

The slats may, for example, be several meters long, while the cross-beams may be spaced apart by a distance in the range between 1 and 2 meters. The channel length of a bracket may conveniently be from 4 to 8 cm.

The bracket 22 has a horizontal flange 24 serving simply for fastening the bracket to the cross-beam 20. The characteristic portion of the bracket is formed by the vertical plate 26, extending downward from the mounting flange 24 and its two externally barbed ridges 27 and 28 facing outward, upon which the channel lips 14, 16 and 15, 17 of the slat 10 may be snapped. The barbed ridges 27 and 28, together with the portion of the vertical base 26 from which they extend constitute the catch channel for retaining the slat 10 in position after it is put in place by pushing the beads 16 and 17 against the oblique surfaces of the barbed ridges 27 and 28, spreading the lips 16 and 17 apart until they snap into the position shown in FIG. 1, where each bead fits into a notch of rectangular or square profile. For release of the awning slat from the bracket 22, the lips 16 and 17 can be spread apart on either side of the bracket, so as to disengage the snap fastening. The slat can also be slid lengthwise out of engagement against the friction of the snap joint.

Figure 2:
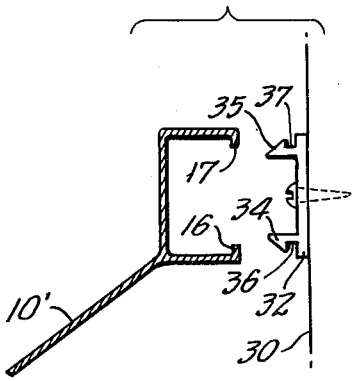
FIG. 2 is a cross-sectional view of a barbed channel bracket affixed to a vertical support surface and the bifurcated support edge of an awning slat according to the invention, in position for snapping onto the barbed channel brackets.
Figure 4:
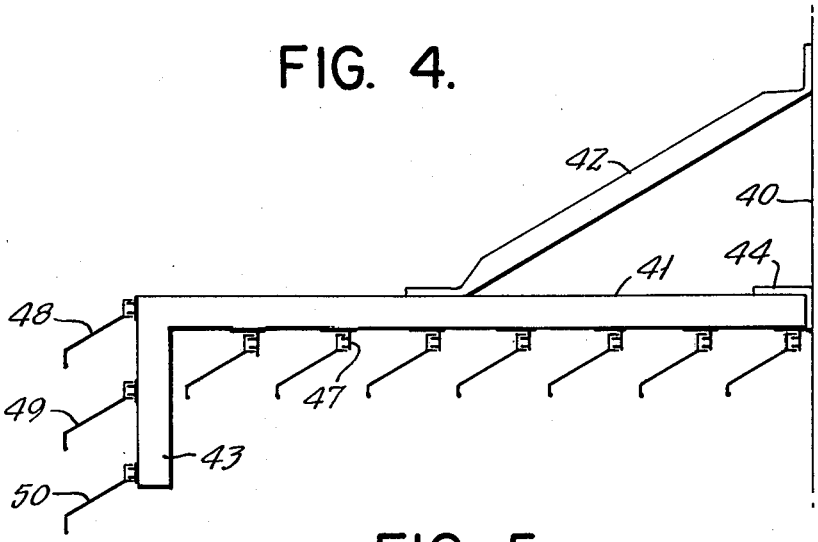
FIGS. 4, 5 and 6 are diagrammatic end views of typical awning structures that can be made utilizing awning slats of FIG. 1 snapped onto barbed channel bracket supports of FIG. 1 or FIG. 2.
Figure 5:
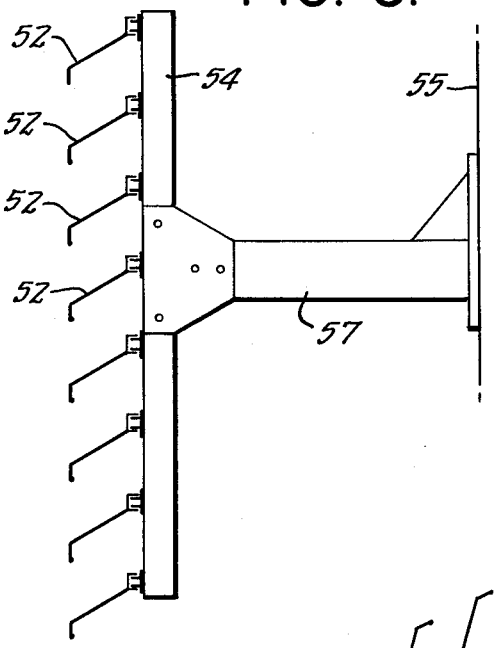

FIG. 2 shows a support bracket 32 fastened on a vertical support surface which may be a front cross-beam portion such as that shown in FIGS. 4 or 5, or may be the wall of a building. The bracket 32 has a profile of an externally barbed channel of which the base is vertical and there are two horizonal lips with outward barbs 34 and 35. Catch grooves 36 and 37 receive the lips 16 and 17 of partly shown slat 10' illustrated in position for snapping the slat on the support member 32.

Figure 3:
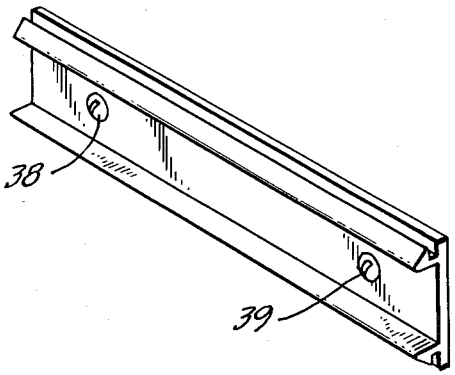
FIG. 3 is a perspective view of the channel bracket of FIG. 2.

FIG. 3 is a perspective view of a channel bracket of the kind shown in FIG. 2. The edges of fastening screws appear at 38 and 39.

FIG. 4 illustrates an awning suspended from a building wall 40 by means of cross-beams 41, equipped with suspension braces 42 and vertical end portions 43. Connection of the cross-beam 41 to the wall 40 is facilitated by the use of an angle bracket 44. Seven slats are suspended on the underside of the cross-beams 41 by means of brackets 47 of the form of the bracket 22 as shown in FIG. 1. Three slats 48, 49 and 50 are suspended on the front of the vertical member 43 in the manner illustrated in FIG. 2.

FIG. 5 illustrates an awning structure provided in the form of a vertical array of slats 52, mounted on vertical cross-beams 54, supported in a spaced position from the building wall 55 by means of horizontal beams 57. The slats 52 are supported by snap connections, in accordance with the invention, of the kind illustrated in FIG. 2.

Figure 6:
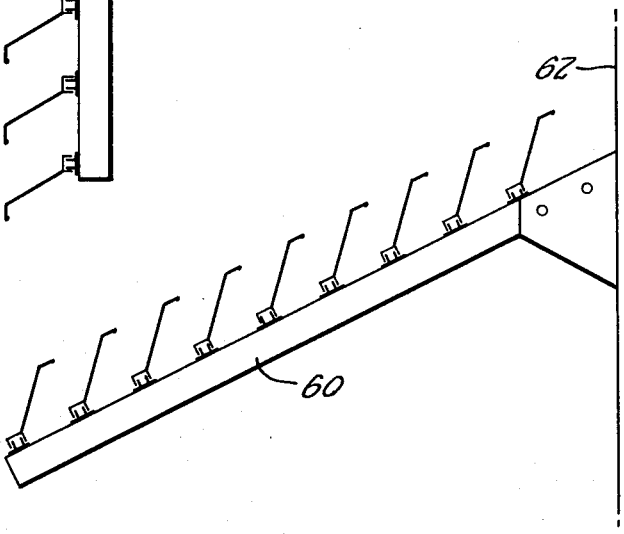

Snap connections of the kind illustrated in FIG. 2 are utilized in the arrangement of FIG. 6 to provide an oblique array of awning slats mounted on top of cross-beams 60 supported on a building wall 62. This possibility of holding slats with their mounting edge down rather than up shows the value of making both the beads 16 and 17 and the notches into which they fit of substantially rectangular or square profile, so that either bead could be used to push against the far edge of the notch it fits into. Another reason for the same feature is that a strong updraft on a slat suspended as in FIG. 1 would reverse the torque applied to the bracket, making the bead 17 push and the bead 16 pull.

The usual economical alloys commonly used for making extruded aluminum slats have adequate mechanical properties for forming connecting features illustrated in FIGS. 1 and 2 in accordance with the invention.

It is advantageous that the barbed profile is provided on the short bracket pieces while, the long slats need to carry only an enveloping channel of essentially slat thickness provided with simple beads, preferably square. It is also advantageous for the broad flat web of the slat to attach obliquely at or near the channel corner or bend 19, where the webs 13 and 14 meet, for transmitting the forces generated by the leveraged slat weight to the snap connections with the support brackets.

Production of the slat and its channel-like bifurcated edges needed for support in accordance with the invention all in one integral piece by extrusion is convenient for determining the angle between the broad portion of the slat and the suspension surface. Of course, the downward extending portion 26 of the bracket of FIG. 1 need not be vertical, but since it is convenient to attach the slat to vertical surfaces in the manner of FIG. 2, as well as to hang it from a cross-beam or support it from below on a cross-beam, it is advantageous to make the awning slats with a fixed angular relation of the broad surface of the slat to the channel profile by which it is connected to support brackets in accordance with the invention. Thus, one universal slat shape can be used and a single shape of extrusion dies will suffice for all slats of a particular width.

The vertical end 11 of the slat shown in FIG. 1 is not essential, but it provides a pleasing appearance and may help to keep the wind from getting under the slats and blowing them upwards.

The word "rectangular" is used herein in its strict sense, which includes "square," and not as a synonym for "oblong."

Although the invention has been disclosed with reference to a particular illustrative embodiment, which has been found to provide for secure fastening and good design of assemblies, it will be understood that modifications and variations are possible within the inventive concept.

We claim:

1. A metal awning structure having at least one awning slat, directly held in position at spaced locations along the same lateral boundary of said slat, on at least two brackets, said brackets each having a base portion and two parallel ridges outstanding therefrom in the same direction in channel configuration, said ridges being oppositely barbed and providing a substantially rectangular notch groove between each barb and said base portion, said awning slat being bifurcated along one edge into a channel-shaped web obliquely joined to the remainder of the slat at one channel corner of said channel-shaped web, the free edges of said channel-shaped web being oppositely beaded and being spaced apart so as to fit onto said brackets by snap action, said beads being of substantially rectangular profile and fitting into said notches for support of said slat on said brackets.

2. Awning structure as defined in claim 1 in which said ridges of said brackets are outwardly barbed, in a configuration providing a narrow inner free edge and an oblique end surface continuing into a barb surface, and said free edges of said channel-shaped web of said slat are inwardly beaded.

3. Awning structure as defined in claim 2 in which said brackets are provided with a flange substantially at right angles to said base and are suspended from and fixed to cross-beams from which other slats are similarly suspended by means of other brackets of the same bracket configuration.

4. Awning structure as defined in claim 1, 2 or 3 in which said slat and said brackets both consist of extruded aluminum alloy pieces.

5. A metal awning structure having at least one awning slat directly held in position, at spaced locations along the same lateral boundary of said slat, on at least two brackets, said brackets each having a base portion and two parallel ridges outstanding therefrom in the same direction in channel configuration, said ridges each being outwardly barbed and in a configuration providing a narrow inner free edge and an oblique end surface extending to the barb apex, said awning slat being bifurcated along one edge into a channel-shaped web obliquely joined to the remainder of the slat at one channel corner of said channel-shaped web, the free edges of said channel-shaped web respectively having inwardly projecting beads and being spaced apart so as to fit onto said brackets by being spread apart and then snapping on with said beads fitting behind the barb edge, and at least the lowermost bead fitting into a groove between the adjacent channel barb and said base of said bracket.

6. Awning structure as defined in claim 5, in which said beads are of substantially rectangular profile and in which said groove is likewise of rectangular profile.

7. Awning structure as defined in claim 5, in which said brackets are each provided with a flange substantially at right angles to said base and are suspended from and fixed to cross-beams from which other slats are similarly suspended by means of other brackets of the same bracket configurations.

8. Awning structure as defined in claim 5, 6 or 7 in which said slat and said brackets both consist of extruded aluminum alloy pieces.

9. An extruded aluminum alloy awning slat for suspension horizontally from one lateral edge by snap action connection to two or more spaced brackets, said slat having a main web for shade-producing purposes which is integrally joined along one edge thereof to a channel-shaped web, extending, in profile, obliquely out from a corner of the channel-shaped web, said channel-shaped web having parallel portions, the free edges of which are provided with inward-facing beads.

10. An aluminum alloy awning slat as defined in claim 9 in which said inward-facing beads are of substantially rectangular profile.

11. An aluminum alloy awning slat as defined in claim 9 or 10 in which in the rest position said beads are about 2 cm apart and in which the width of said slat is at least about 10 cm.

* * * * *